United States Patent [19]

Broz

[11] 4,326,951

[45] Apr. 27, 1982

[54] ELECTROSTATIC MINERAL CONCENTRATOR

[76] Inventor: Frank J. Broz, 8204 Easter Cove, Austin, Tex. 78758

[21] Appl. No.: 131,007

[22] Filed: Mar. 17, 1980

[51] Int. Cl.[3] ..... B03C 7/10

[52] U.S. Cl. ..... 209/127 R; 209/129

[58] Field of Search ..... 209/127 R, 131; 55/118–120, 149

[56] References Cited

U.S. PATENT DOCUMENTS

| | | | |
|---|---|---|---|
| 1,222,305 | 4/1917 | Kravs | 209/127 B |
| 2,168,681 | 8/1939 | O'Brien | 209/127 A |
| 2,246,253 | 6/1941 | Johnson | 209/129 |
| 2,428,224 | 9/1947 | Johnson | 209/127 R X |
| 2,615,570 | 10/1952 | Morrison | 209/127 C |
| 2,635,749 | 4/1953 | Cropper | 209/127 B |
| 2,787,331 | 4/1957 | Linderoth | 209/127 B X |
| 2,866,546 | 12/1958 | Roberts | 209/127 R X |
| 3,143,492 | 8/1964 | Bullock | 209/127 R |
| 3,275,139 | 9/1966 | Butello | 209/129 |
| 3,322,275 | 5/1967 | Breakiron | 209/127 R |
| 3,341,007 | 9/1967 | Mayer | 209/127 R X |
| 3,370,707 | 2/1968 | Carpenter | 209/127 R |
| 3,426,895 | 2/1969 | Bullock | 209/129 |
| 3,581,886 | 6/1971 | Sirgedald | 209/9 X |
| 3,704,571 | 12/1972 | Burney | 55/118 |
| 3,912,467 | 10/1975 | Trup | 55/149 |

FOREIGN PATENT DOCUMENTS

| | | | |
|---|---|---|---|
| 691165 | 4/1940 | Fed. Rep. of Germany | 209/127 R |
| 700976 | 12/1940 | Fed. Rep. of Germany | 209/127 C |
| 847431 | 8/1952 | Fed. Rep. of Germany | 209/127 B |
| 1154051 | 9/1963 | Fed. Rep. of Germany | 209/127 R |
| 636743 | 3/1962 | Italy | 209/127 R |
| 569325 | 11/1977 | U.S.S.R. | 209/127 R |

*Primary Examiner*—Robert Halper

*Attorney, Agent, or Firm*—Pravel, Gambrell, Hewitt, Kirk, Kimball & Dodge

[57] ABSTRACT

An apparatus for electrostatically concentrating mineral particles includes a pair of oppositely charged collector electrodes spaced apart from each other and oriented so that a flow path is formed between them where material containing mineral particles can fall by gravity through at least a major portion of the flow path and the mineral particles will be charged and attracted to the electrodes. Each electrode includes a collector surface formed of a dielectric material which defines at least a substantial portion of the flow path. Ionizers are located midway between the collector electrodes for charging mineral particles at a plurality of locations along the flow path.

5 Claims, 8 Drawing Figures

Fig. 5
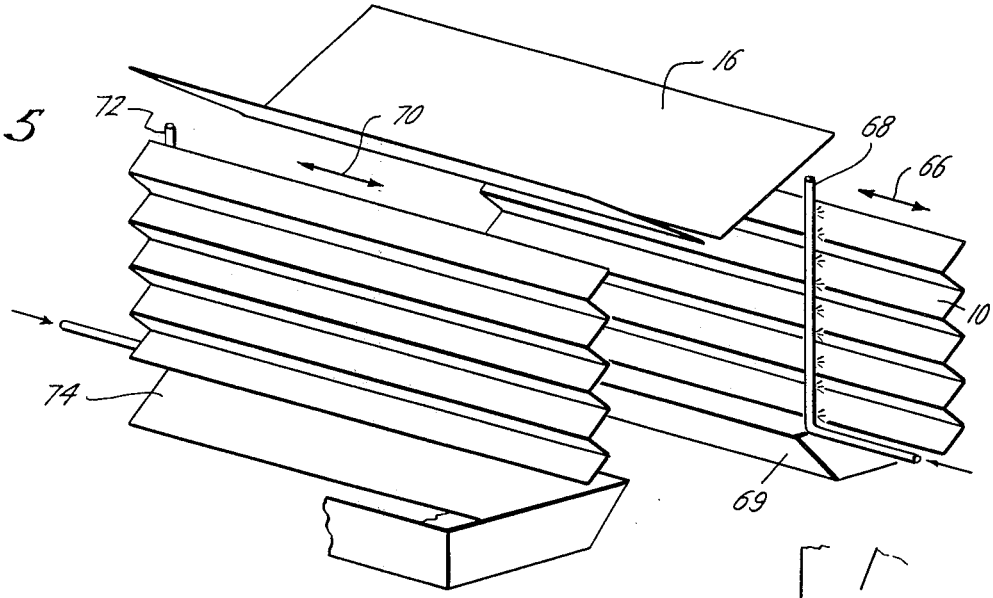
Fig. 6
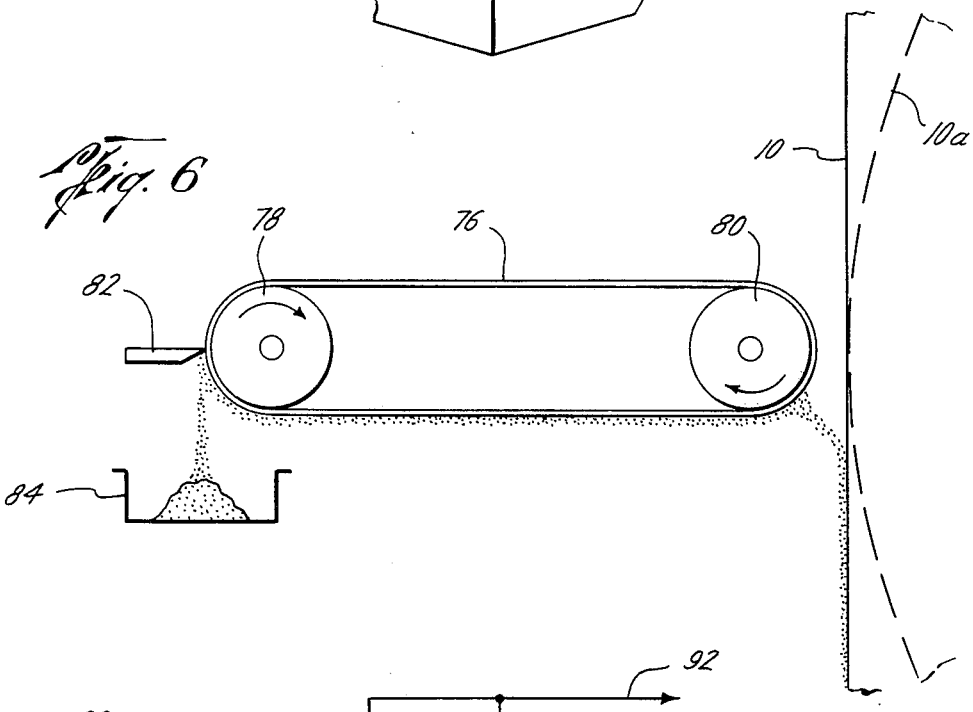
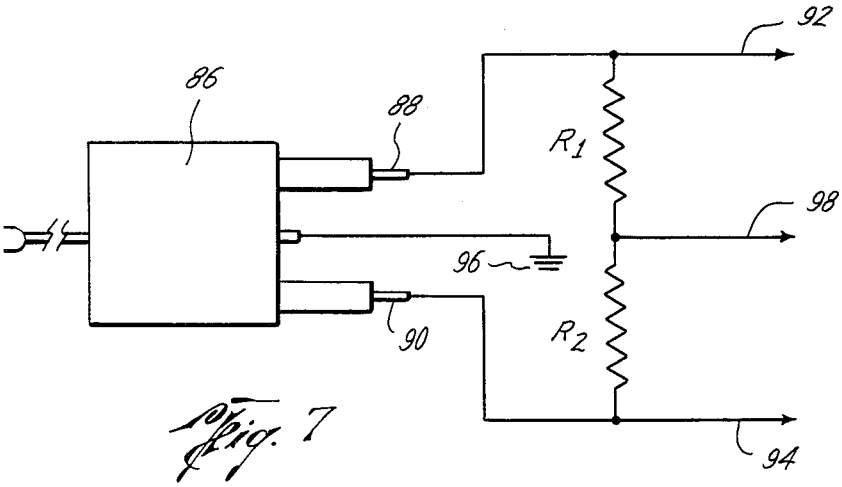
Fig. 7

ELECTROSTATIC MINERAL CONCENTRATOR

BACKGROUND OF THE INVENTION

This invention broadly relates to the removal of mineral particles from other material and, more particularly, to an apparatus for electrostatically increasing the concentration of particles of precious metals in other material prior to a final separation step.

As the value of precious metals such as gold and silver continues to increase sources of these metals which in the past were not considered economically attractive for processing are now receiving closer attention. These sources include ore deposits as well as tailing or refuse dumps of previous removal operations.

Various factors such as, for example, the availability of ore with small mineral particles in relatively low concentrations and a greater concern about environmental pollution have resulted in a re-evaluation of the three most popular methods for removing gold of flotation, amalgamation and cyanidation. These three methods all use chemical reagents and were popular because they were at one time considered to be economical. However, now that environmental laws require that most contaminants be removed before dirt is returned to the original site, electrostatic separation for precious metals is being more seriously considered.

Since the particles to be removed are very small (gold particles, for example, have irregular shapes and range from less than a micron to greater than 0.1 inch in their largest dimension) the object of an initial processing step such as the one to which the present invention is directed is to remove a large amount of the non-precious material including the larger pieces so that the material which remains contains the precious metal in a relatively high concentration.

Although electrostatic precipitators have been used for separating or concentrating metal particles, in most prior art electrostatic mineral concentrators a collector electrode was either positively or negatively charged instead of having parallel collectors with different polarities. Such devices are the subject of U.S. Pat. Nos. 813,063; 2,270,526; 2,361,946; 3,012,668; 3,031,079 and 3,477,568. It was noticed in experiments with a parallel-plate electrostatic collector where a charge was placed on only one collector plate and the other plate was grounded and not charged as would normally be done, that the metal particles tended to collect on the grounded plate and in cracks and crevices around the grounded plate so that those particles were lost in the tailings.

However, even with electrostatic collectors where collector electrodes of different polarities are used such as in U.S. Pat. Nos. 856,711 and 3,720,312 maximum collection efficiency is not achieved because, it is believed, as the particles move through the concentrator they become attracted to one another, oftentimes neutralizing each other so that they are not collected and are lost in the tailings. It is also believed that as particles move through an electrostatic concentrator there are constant collisions between the particles, causing some of them to lose their charge and not be collected. When collecting precious metals such as gold it is obviously important to maximize the efficiency of the collection process.

SUMMARY OF THE INVENTION

In accordance with the invention, a pair of oppositely charged collector electrodes are spaced apart from each other and oriented so that a flow path is formed between them where material containing mineral particles to be collected can fall by gravity through at least a major portion of the flow path. The electrodes are coated with a dielectric material on the side defining the flow path. The mineral particles are charged and attracted to the electrodes and then collected on the outer surface of the dielectric coating.

An ionizing means in the form of a rod or wire is located midway between the collector electrodes at a plurality of locations along the flow path so the mineral particles are re-charged as they travel along the flow path. At various points along the flow path, the material is channelled toward the center of the flow path to be concentrated as it flows past the ionizers or the material is brought together at the collecting surface of one of the collector electrodes for concentrating a charge in the particles and for providing a mixing action so that additional particles can be collected.

In one embodiment, the flow path can be formed between two spaced-apart, vertical, collector electrodes which define a vertical flow path. Screens can be located along both sides of the flow path to prevent larger dirt particles from being collected on the electrodes. A series of oppositely-facing and inwardly-deflecting baffles which are spaced apart from each other are disposed along the flow path with the ionizers located at the opening between the baffles so that material will periodically be channelled toward the ionizers and re-charged as it flows along the flow path. Alternatively, a plurality of pairs of spaced-apart collector electrodes can be arranged in series along the flow path with a different potential between each pair for maintaining a voltage gradient along the flow path. If a lower voltage is maintained at the upstream end of the flow path and a higher voltage at the downstream end smaller particles will tend to be collected at the top with increasingly larger particles tending to be attracted to succeeding collectors.

Other embodiments combine rotating drum collector electrodes with vertically-oriented collector plates for defining the flow path or utilize collector electrodes formed in a zig-zag or saw-tooth pattern. In both of these embodiments the shapes and location of the collector electrodes are such that the electrodes themselves deflect and channel the material past the ionizers and onto the collectors as it flows by gravity through the flow path.

For electrodes in the form of plates the collected material can be removed by spraying the collector electrode with water or a suitable liquid solution after disconnecting the electrostatic field so that the collected metal will wash into a trough located beneath the electrode or by moving the collector electrode back and forth across a spray of water or other liquid solution. For revolving drum electrodes, the material can be scraped off by a rubber scraper, soft bristle brush or the like. Alternatively, a revolving belt formed of a dielectric material mounted on at least one drum with an electrostatic potential of the same polarity but greater in value than that of the collector electrode can be moved past a portion of the electrode outside of the electrostatic field. The collected particles will migrate from the electrode onto the belt and can be appropriately removed.

In this way material containing small quantities of precious metals such as, for example, gold can be effectively and efficiently concentrated to contain a significantly greater proportion of the precious metal. Optimum conditions are created for attracting the metal to collector electrodes as the material falls by gravity between collector electrodes by making sure that the metal particles do not lose their charge and that at some point along the flow path they are attracted to collector electrodes.

BRIEF DESCRIPTION OF THE DRAWINGS

A better understanding of the invention can be obtained when the detailed description of preferred embodiments set forth below is considered in conjunction with the drawings, in which:

FIG. 5 is a perspective view of the embodiment of FIG. 4 and shows in particular how the collector electrodes can be moved back and forth across a liquid spray for removing collected mineral particles;

FIG. 6 is a front view of an endless belt collector for removing particles from collector electrodes;

FIG. 7 is a schematic circuit diagram for an embodiment of the invention where a single set of collector electrodes is used.

DETAILED DESCRIPTION OF PREFERRED EMBODIMENTS

Figure 1:
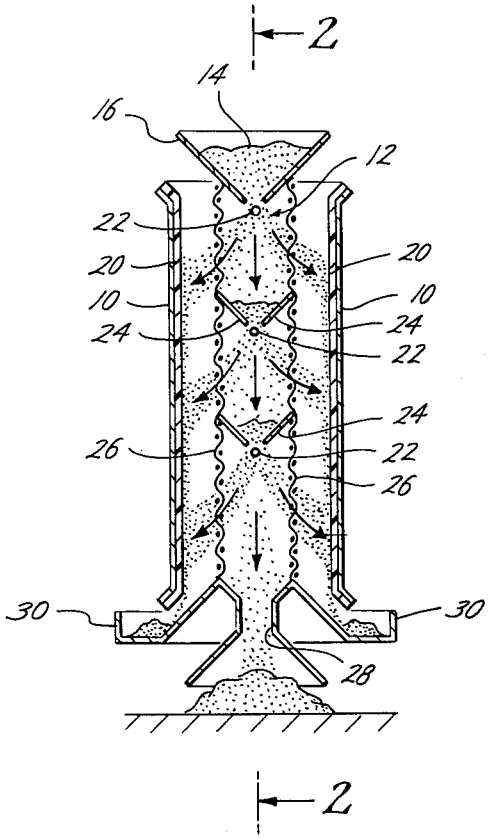
FIG. 1 is a front sectional view of one embodiment of the invention where the flow path is defined between a pair of spaced-apart, parallel, vertically-oriented collector electrode plates.

In the embodiment of the invention shown in FIG. 1, which was found to be the most effective of the embodiments shown, a pair of vertical collector plates 10 are arranged parallel to and spaced apart from each other to form a flow path 12. Material 14 with metal particles in it is introduced into the flow path 12 from a hopper 16. The flow path 12 is oriented so that the material 14 will flow by gravity through at least a substantial portion of the apparatus.

The collector electrodes 10 are formed of metallic plates which are oppositely charged so that the metal particles traveling along the flow path 12 will be attracted to a plate regardless of the polarity of the particle. Each plate 10 is coated on its inner collecting surface 20 with a dielectric material such as, for example, Teflon for preventing arcing between the plates and for providing a suitable surface for capturing and holding the metal particles until they can be removed.

To insure that the metal particles are charged, an ionizing rod or wire 22 extends parallel to the electrode plates 10 and midway between them across the flow path 12 at the outlet opening of the hopper 16 and at various locations along the flow path 12. In this way an initial charge is imparted to the particles and if a particle should lose its charge by colliding with other particles before being attracted to a collector electrode, the particle will likely be re-charged as it flows past successive ionizers 22.

A series of inwardly-converging pairs of deflectors 24 are also provided along the flow path 12 for slowing movement of the material and to channel the material past the ionizers 22 which are located in the gap between the deflectors through which the material flows. The deflectors 24 also operate to periodically guide the material back to the center of the flow path 12 for preventing the collector electrodes from attracting large, heavy particles which may be charged but which should not be collected and for mixing the material so that all particles will have a better opportunity to be exposed to a collector electrode. A screen 26 is an optional feature which can be provided between the outer ends of the deflectors 24 and the dielectric coating 20 on both sides of the flow path 12 for preventing larger particles of the material from being attracted to the collector electrodes 10. These screens can be positioned so that they are closer to each other at the top of the flow path 12 than at the bottom.

Material which is not attracted to one of the collector electrodes 10 flows from the flow path 12 through an opening 28 into a tailing hopper or the like. The particles which are attracted to the collector electrodes 10 can be removed from the dielectric coating 20 by any suitable means such as, for example, interrupting the flow of material 14 through the flow path 12 and disconnecting electric current from the electrodes and spraying liquid across the face of the dielectric material 20 for washing the material into collecting troughs 30. If the electrodes are properly insulated, however, the current does not have to be disconnected. Alternatively, as discussed in conjunction with FIG. 5, the collector electrodes can be moved back and forth across a spray located outside of the flow path 12 or the particles can be removed by using a collector belt such as the one shown in FIG. 6 and described below.

Instead of providing a single pair of collector plates 10, the flow path 12 can be defined by a plurality of pairs of collector plates (not shown) arranged in series and electrically insulated from each other. A different electric potential can be formed between each pair of plates to form a voltage gradient along the flow path from a relatively low voltage at the top to a relatively high one at the bottom. This allows smaller particles to be removed at the upstream end of the flow path and larger particles along with smaller ones not removed previously to be removed downstream.

In the embodiment of the invention shown in FIG. 3, material 14 located in the input hopper 16 is introduced into the flow path 12 which is defined in part by collector electrodes in the form of rotating metallic drums coated with a dielectric material and described in detail below. As with the embodiment of the invention shown in FIGS. 1 and 2, a plurality of ionizing rods or wires 22 extend across the center line of the flow path 12 for charging the materials as they travel along the flow path.

When material leaves the hopper 16 it first flows between a pair of oppositely-charged counter-rotating drums 32 and 34 which rotate in the direction of arrows shown on the drums. The drums themselves are the collector electrodes and are coated with a dielectric material similar to the collector electrodes 10 shown in FIGS. 1 and 2. Charged metal particles will be attracted to the drums and can be scraped off by rubber scrapers 36, soft bristle brushes, squeegees or the like. The removed particles will fall into troughs 38 and be transported for further treatment.

Figure 2:
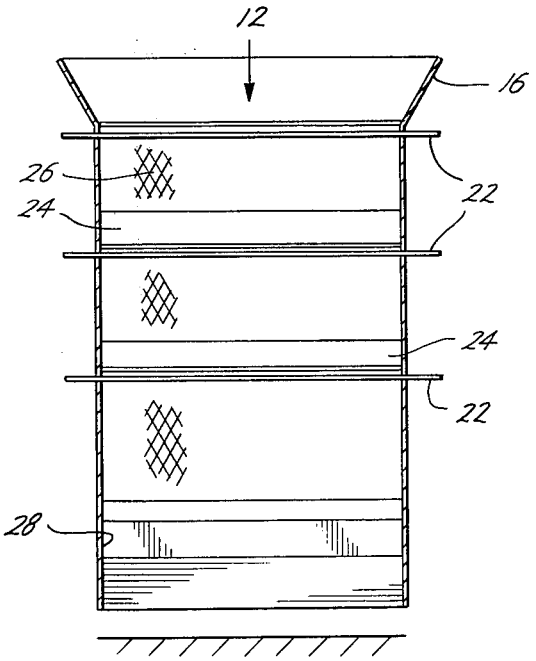
FIG. 2 is a side sectional view of the embodiment shown in FIG. 1 looking along a section line in the direction of arrows 2—2 as shown in FIG. 1.

The next stage of the flow path 12 is defined on one side by another rotating drum collector 40 which rotates in the direction indicated by an arrow shown on the drum and on the other side by an oppositely charged collector plate 42 formed similar to the plates 10 shown in FIGS. 1 and 2. A rubber scraper 44 or the like removes the collected materials from the outer surface of the drum 40 and deposits them in a trough 46. The collected materials can be removed from the collector electrode plate 42 and deposited in a trough 47 in a manner similar to that described above in connection with the embodiment shown in FIGS. 1 and 2.

A screen 48 is provided between the ionizing rods or wires 22 and the collector electrode 42 for screening out larger particles of material. A deflector plate 50 is located between the drums 32 and 40 for deflecting and guiding material along the flow path 12. It should be noted that in this embodiment although material travels throughout a substantial portion of the flow path 12 by gravity, rotary motion of the drum 40 imparts a supplemental moving force to the materials.

After the material flows between the drum 40 and collector plate 42 it is guided toward another part of the flow path 12 defined by a revolving drum collector 52 and a collector plate 54 by a deflector 56. These collector electrodes are oppositely charged, as are the ones described above which define preceding portion of the flow path 12, and define the last stage of the flow path 12. A screen 55 is located between the ionizers 22 and plate 54. Material is removed from the drum 52 by means of a rubber scraper 57 or the like into a trough 58 and from the plate 54 into a trough 60. The non-collected material then flows through the outlet opening 62 into a tailings bin or the like for disposal or further treatment.

Figure 3:
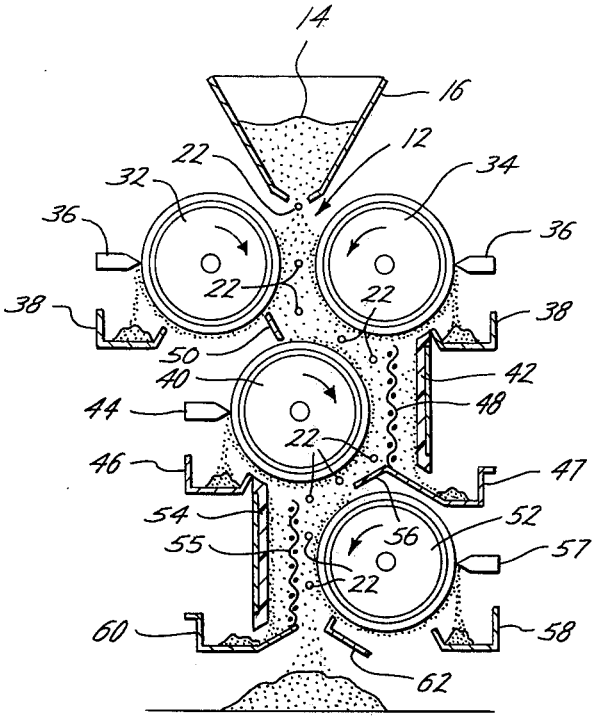
FIG. 3 is a front sectional view of a second embodiment of the invention where the flow path is defined between electrodes in the form of vertical plates and revolving drums.

As mentioned in connection with the embodiment shown in FIGS. 1 and 2, the collectors of FIG. 3 which define succeeding stages of the flow path 12 can be provided with different electric potentials by providing a lower voltage at the upstream end of the flow path 12 and gradually increasing voltage between each succeeding pair of collector electrodes to establish a voltage gradient along the flow path 12.

Figure 4:
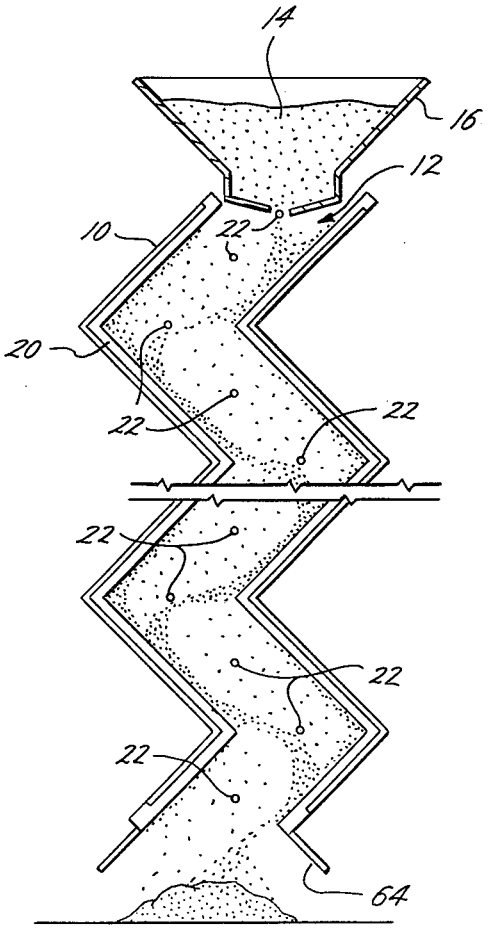
FIG. 4 is a front sectional view of a third embodiment of the invention where the flow path is defined between parallel zig-zag or saw-tooth shaped collector electrodes.

A third embodiment of the invention is shown in FIG. 4 where the collector electrode plates 10 are formed in a zig-zag or saw-tooth configuration and, like the other embodiments, include a dielectric collector surface 20. When the material 14 flows from the input hopper 16 it will flow through a zig-zag flow path with the material striking the dielectric surface 20 on one plate and deflect to the next succeeding surface on the other plate. A plurality of these changes of direction cause the material to flow past the ionizing rods or wires 22 so that the particles to be removed are continually recharged and then come directly in contact with a dielectric collecting surface 20 for effective removal of the metal particles. The material which was not removed flows through an opening 64 into a suitable tailings bin or the like. Instead of providing a single pair of saw-tooth shaped plates 10, a plurality of pairs of plates can be arranged in series and different potentials formed between succeeding plates as described above in connection with the other embodiments.

As in the other embodiments described above, the material which has been attracted to the collector electrode plates 10 can be removed by spraying the dielectric surface with liquid as described above. Removal can also be accomplished as shown in FIG. 5 where the collector electrode 10 is moved as shown by an arrow designated by reference numeral 66 away from its collecting position and past a vertical pipe 68 from which liquid is sprayed onto the dielectric surface for removing the collected material and washing it into a trough 69 located near the bottom of the electrode 10. The other electrode 10 can be moved as shown by an arrow designated by reference numeral 70 in the other direction past a second vertical spray pipe 72 so that collected material attracted to that electrode plate can be washed into a trough 74.

Another way of removing collected material from collector electrodes is illustrated in FIG. 6 where a revolving belt 76 formed of a dielectric material such as Teflon is mounted on two rotating drums 78 and 80 which revolve in the direction shown by the arrows on the drums. An electric potential is applied to the drum 80 which is of the same polarity but higher in value than the potential on the collector plate 10 (or drum as shown by the dotted lines 10*a*). As the belt 76 rotates, the difference in electric potential will cause the particles on the collector plate 10 to be attracted to and collect on the belt 76 as shown schematically in FIG. 6. The particles are then transported by the belt 76 to where a rubber scraper 82, soft bristle brush or the like will remove the particles from the belt 76 and cause them to fall into a collecting trough 84. This procedure can be accomplished for drum collectors by positioning the revolving belt 76 on the side of the drum away from the electrostatic field or for plates by moving a revolving belt past each plate.

A schematic diagram of illustrative electronic circuitry which can be used for operating the concentrators described above where a single pair of collector electrodes is provided is shown in FIG. 7. A high voltage power supply 86 supplies power through a positive high voltage electrode outlet 88 and a negative high voltage electrode outlet 90 to the oppositely-charged collector electrodes through lines 92 and 94, respectively. A ground terminal 96 can also be provided. A line 98 is connected between the lines 92 and 94 and supplies power to the ionizers. There is a voltage drop in the line 98 across resistors R1 and R2 which equal each other so that the system is symmetrical.

When the collector electrodes are formed in a plate-like shape both the inner and outer surfaces can be coated with a high dielectric material such as plexiglass, Teflon, polyethelene or the like. A wooden protective covering can be applied to the outer surface of each plate.

The gap between the collector electrodes can be, for example, approximately $\frac{1}{4}$ of an inch for plates such as those shown in FIGS. 1 and 2. Each plate can have a 0.010 inch coating of Teflon. For this configuration a high voltage setting of about 10–30,000 volts, alternating or direct current, is considered satisfactory. However, the gap between collector electrodes and the voltage will vary according to the sizes of the material handled. It is usually found that the gap between the collector plates can range from $\frac{1}{4}$ inch to 6 inches and the voltage can vary from just above 0 to 50,000 volts.

Normally the size of the material should be prescreened so that the largest particles are $\frac{1}{8}$–$\frac{1}{4}$ inch in size. When gold is to be extracted the size of the irregularly shaped gold particles will range from 1 micron to greater than 0.1 inch for the largest dimension.

Figure 8:
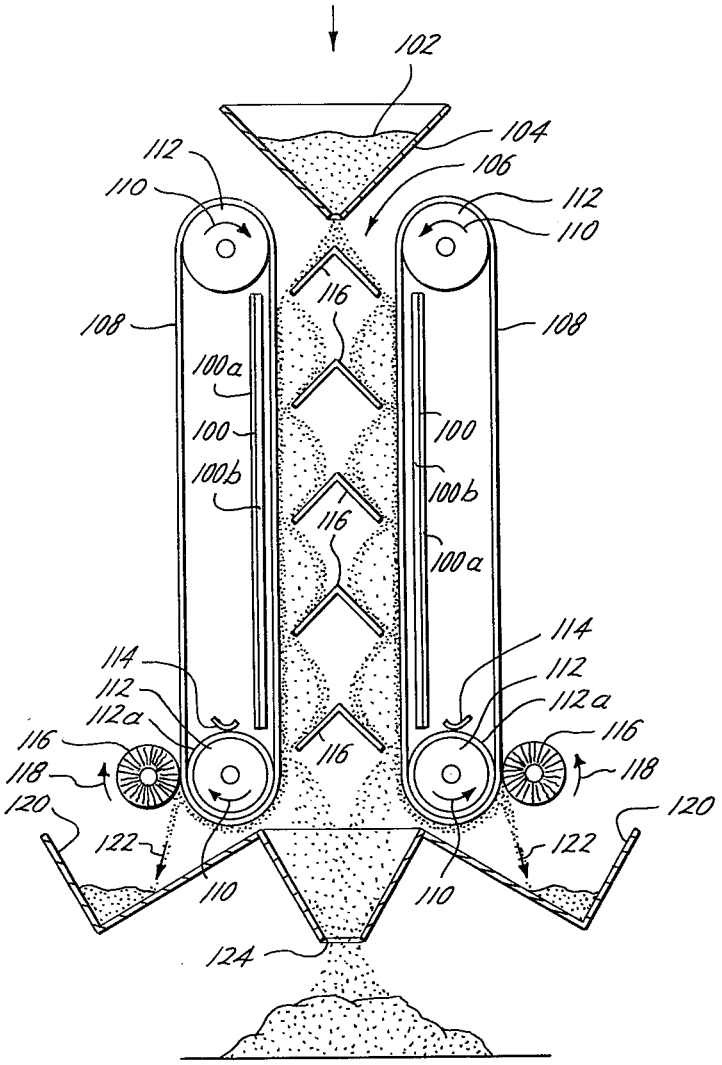
FIG. 8 is a front sectional view of another embodiment of the invention where the parallel plates of FIG. 1 are combined with belt collectors as shown in FIG. 6 and a different baffle configuration is used.

An embodiment of the invention in which the best results were achieved is shown in FIG. 8 where a pair of collector electrodes 100 are provided which are formed essentially the same as those shown in FIG. 1. Material 102 is deposited in a hopper 104 which flows from the bottom of the hopper through a flow path 106 which is formed between a pair of endless belt collectors 108 which revolve in the direction of arrows 110. As shown, one side of the belt 108 is spaced from the charged collector electrode 100 and the outer surface of the belts 108 form the collector surface for the electrodes 100. The belts are formed of a high dielectric material such as, for example, polyethelene and are mounted on rollers 112, at least one of which is rotated for moving the belt in the direction of the arrows 110. As discussed above, the electrode plates 100 are formed of a metallic outer portion 100*a* and an inner portion 100*b* formed of a high dielectric material such as, for example, Teflon. The upper roller 112 is insulated (not shown) by coating its outer surface with a high dielectric material such as, for example, polyvinyl chloride. The lower rollers 112 are charged by providing an outer cover 112*a* formed of a conductive material with an electric current being applied to the cover 112*a* through slip rings 114.

A plurality of inverted V-shaped baffles 116 are spaced apart and centered along the flow path 106, each baffle 116 being charged to serve the dual function of deflecting material flowing through the flow path 106 and ionizing the material as described above. It will be appreciated that the baffles 116 are combined material deflectors and ionizers. For this embodiment, the belts are spaced approximately six inches apart and are about 36 inches wide. The baffles are formed with their legs oriented about 90° relative to each other and are spaced about 4-$\frac{1}{2}$ inches apart. When a volt of about 30,000 watts is applied, it was found that about 11.2 tons per hour of material flour gold can be processed with a recovery rate of about 20–25 milligrams per pound or 1.4 tray ounces per ton of gold recovered.

As shown by the schematic characterization of material moving through the flow path 106, material is continually deflected by the baffles 116 against the collector surface of the belts 108 and continually charged by ionization created by the field between the sharp lower edge of the baffles 116 and the collector plates 100. Particles collected on the belts 108 are removed by means of a soft bristle brush 116 rotating in the direction of arrows 118, which is opposite to movement of the belt 108 so that material will fall downwardly into a collecting trough 120 as indicated by arrows 122. Material which is not collected falls downwardly through an opening 124 at the bottom of the flow path into a collector bin or the like.

Thus, an electrostatically operated mineral concentrator is provided which utilizes gravity for guiding material containing precious metal particles past collector electrodes. Maximum removal is accomplished by causing the material to flow between oppositely charged plates and the material is continually recharged to insure that all the particles to be removed remained charged so that they will be collected. In this way, maximum recovery of precious materials such as gold can be accomplished.

The foregoing disclosure and description of the invention are illustrative and explanatory thereof, and various changes in the size, shape and materials as well as in the details of the illustrated construction may be made without departing from the spirit of the invention and all such changes are contemplated as falling within the scope of the appended claims.

I claim:

1. Apparatus for electrostatically concentrating non-magnetic mineral particles comprising:

(a) at least one pair of oppositely charged collector electrodes spaced apart from each other and oriented so that a flow path is formed between them where material containing non-magnetic mineral particles can fall by gravity through at least a major portion of the flow path and the non-magnetic mineral particles will be charged and attracted to the electrodes, the collector electrodes each including a collector surface formed of dielectric material which together define at least a substantial portion of the flow path;

(b) ionizing means located midway between the collector electrodes for charging mineral particles at a plurality of locations spaced apart along the flow path;

(c) means for deflecting the mineral particles provided at a plurality of locations along the flow path so that the particles are periodically deflected from a straight-line path as they fall by gravity through the flow path;

(d) means for supplying electrical energy to the electrodes and ionizing means;

(e) means for introducing the material containing mineral particles at an upper portion of the flow path;

(f) means for removing collected particles from the collector electrodes; and (g) the flow path including a first stage defined between a pair of revolving collector electrode drums spaced apart from each other, and a plurality of succeeding stages each defined between a revolving collector electrode drum on one side and a vertical plate on the other side.

2. The apparatus of claim 1, wherein the revolving drum in each succeeding stage is located beneath the preceding flow path section so that material will fall directly on the drum.

3. The apparatus of claim 1, wherein the ionizing means includes a metal wire extending across the flow path at a plurality of locations along the flow path.

4. The apparatus of claim 1 wherein spray means for spraying liquid onto the collector surface of each plate is located at a side of each plate and means for selectively moving the plates past the spray means, and a trough beneath the plates for receiving material removed from the plates.

5. The apparatus of claim 1, wherein a scraper means contacts the collecting surface of each drum on the side away from the flow path and a trough beneath the scraper means for receiving material removed from the drums.

* * * * *